US008960799B2

(12) United States Patent
Yoon

(10) Patent No.: US 8,960,799 B2
(45) Date of Patent: Feb. 24, 2015

(54) LUMBAR SUPPORT SEAT

(75) Inventor: Wook Yoon, Yongin-shi (KR)

(73) Assignee: Wook Yoon, Kyunggi-do (KR)

( * ) Notice: Subject to any disclaimer, the term of this patent is extended or adjusted under 35 U.S.C. 154(b) by 301 days.

(21) Appl. No.: 13/435,855

(22) Filed: Mar. 30, 2012

(65) Prior Publication Data

US 2013/0043707 A1 Feb. 21, 2013

(30) Foreign Application Priority Data

Aug. 16, 2011 (KR) ..... 10-2011-0081223

(51) Int. Cl.
*A47C 7/02* (2006.01)
*A47C 1/14* (2006.01)

(52) U.S. Cl.
CPC ..... *A47C 7/021* (2013.01); *A47C 1/146* (2013.01)
USPC ..... 297/378.1; 297/284.7; 297/354.11

(58) Field of Classification Search
USPC ..... 297/284.4–284.7, 354.11, 354.12, 357, 297/378.1, 353, 452.29, 452.3, 452.32, 297/452.41, 452.12, 452.14, 183.1
See application file for complete search history.

(56) References Cited

U.S. PATENT DOCUMENTS 1,762,623 A * 6/1930 Hess ..... 297/309
3,713,696 A * 1/1973 Dudley ..... 297/452.55
5,052,076 A * 10/1991 Spaeth ..... 16/266
5,190,344 A * 3/1993 Anderson et al. ..... 297/17
6,089,669 A * 7/2000 Wilcox et al. ..... 297/452.65
6,672,669 B2 * 1/2004 Chu et al. ..... 297/354.12
D588,368 S * 3/2009 McCoy et al. ..... D6/344
8,579,376 B2 * 11/2013 Chen ..... 297/353
2004/0174056 A1 * 9/2004 Gryp et al. ..... 297/284.6
2005/0093356 A1 * 5/2005 Liu ..... 297/353
2006/0170274 A1 * 8/2006 Moule ..... 297/452.25
2008/0185893 A1 * 8/2008 Behrens et al. ..... 297/378.1
2010/0078979 A1 4/2010 Nemoto
2010/0301625 A1 * 12/2010 Lee ..... 296/37.8
2011/0215623 A1 * 9/2011 Tsai ..... 297/301.1

FOREIGN PATENT DOCUMENTS

KR 20-0422757 8/2006

* cited by examiner

*Primary Examiner* — David R Dunn
*Assistant Examiner* — Timothy J Brindley
(74) *Attorney, Agent, or Firm* — Kirton McConkie; Evan R. Witt

(57) ABSTRACT

A lumbar support seat is disclosed for supporting lumbar vertebra portion, which stably supports the lumbar vertebra portion and the pelvis portion so as to maintain proper posture and comfortable sitting. The lumbar support seat includes a seat main body having an upper central portion that is curvedly indented so as to correspond to the shape of pelvis portion; a lumbar supporting die including fixing frames fixed at the upper portion of the rear end of the seat main body, and a base plate for supporting lumbar vertebra portion. The pelvis portion is supported via the seat main body and the lumbar vertebra portion is stably supported via the lumbar supporting die. The lumbar support seat helps a user to sit with proper and comfortable posture.

2 Claims, 6 Drawing Sheets

LUMBAR SUPPORT SEAT

FIELD OF THE INVENTION

The present invention relates to a lumbar support seat, which may softly support the buttock of a user when the user sits on the floor surface and, more particularly, to a lumbar support seat for supporting lumbar vertebra portion, wherein the rear portion of a seat main body and a lumbar supporting die provided thereto naturally push the lumbar vertebra portion and the spine as both side buttock portions of a user press the both side edges of the seat main body, so that the lumbar support seat stably supports the lumbar vertebra portion and the pelvis portion and may help the user to maintain right sitting posture and reduce low back pain so as to comfortably sit for a long time.

BACKGROUND OF THE INVENTION

In general, a mat is made from a proper material or in a proper shape for softly supporting the buttock portion of a user when the user sits on the floor but not for the purpose of keeping the physiological curvature of the backbone.

Therefore, if the user naturally sits on a mat, which is placed on a flat chair, with his feet on the floor, his pelvis portion is apt to be bent backwards while the pelvis portion keeps a forward-bending state in a standing posture, thereby the coccyx, the sacrum and the vertebral column also become bent backwards.

As a result, the vertebral column becomes bent backwards, losing the natural physiological curvature, and the weight of the upper body is applied to the periphery portions of the coccyx and the sacrum, the lower lumbar vetebra portion, the intervertebral discs, or the rear portions of the thighs. Accordingly, the load applied to the waist portion or the coccyx portion becomes increased.

Furthermore, the user may easily sit with his legs crossed, the weight of the upper body that is applied to the hipbone becomes unbalanced, possibly causing the deformation of skeleton.

In order to resolve the above problems, an auxiliary chair for improving sitting posture has been suggested for a chair, which is formed in the size and thickness for a user to seat thereon and includes a seating surface portion curvedly formed in a convex shape on the top portion thereof and having an indented portion 7 formed in the shape of a strip in the center in the back and forth direction, an uplifted portion 10 formed at a front portion of the seating surface portion 6 and smoothly uplifted towards the indented portion 7 at both sides of the indented portion 7, a fan-shaped inclination surface formed at the lower side of the uplifted portion 10 so as to be smoothly inclined in the forward inclination direction, a curved portion 16 formed to be convex in the center of the lower portion of the uplifted portion 10, and stopper portions 17 and 18 formed at the outer side portions of the seating surface portion 6, as shown in FIGS. 1 and 2 (Korean Patent Publication No. 10-2009-0095639).

If a user seats on a chair via the auxiliary chair (a), his legs become spread such that crossing his legs becomes difficult, the pelvis portion becomes bent forwards, and the lumbar vetebra portion is induced to be naturally bent. Therefore, the weight of the upper body that is applied to the periphery portions of the coccyx and the sacrum, the lower lumbar vetebra portion, the intervertebral discs, or the rear portions of the thighs becomes distributed to the legs in balance. Accordingly, the legs are worked out and simultaneously the load applied to the waist or the coccyx may be reduced. Further, the pelvis is prevented to be bent backwards, so that the backword bending of the lumbar vetebra for a long time may be prevented, improving the sitting posture of the user.

As described above, in the case of sitting on a chair or flat floor, if the pelvis is stably supported using an auxiliary instrument, which is indented in the center thereof like the auxiliary chair a, right sitting posture may be kept, promoting the health of the backbone.

In the meantime, in a human body, the pelvis portion indicates a large compound bone structure at the base of the spine, which is formed in the shape of a funnel at the waist portion, and consists of lumbar vertebra portion, the os coxa, the sacrum, the coccyx and the hipbone.

Furthermore, the lumbar vertebra portion is so-called as vertebrae lumbales between the thoracic vertebra and the sacrum in the vertebra, wherein a human has five mallei.

The prior art auxiliary chair a has, however, a disadvantage that the chair has not cushion materials so that the comfortable sitting cannot be expected even though the chair may support the pelvis portion so as to keep the right sitting posture. Furthermore, the prior art auxiliary chair has another disadvantage that the chair cannot support the lumbar vertebra portion, so that a load is applied to the lumbar vertebra portion after a long time sitting, thereby possibly inducing damage or pain.

SUMMARY OF THE INVENTION

The present invention has been conceived in view of the above problems, and an object of the invention is to provide a lumbar support seat, which may comfortably support not only the pelvis portion but also the lumbar vertebra portion by simply sitting thereon without using any additional instruments, so as to keep the right sitting posture while reducing the waist pain and providing comfortable feeling.

In order to achieve the above object, a lumbar support seat according to the present invention includes: a seat main body, of which an upper central portion is curvedly indented so as to correspond to the shape of pelvis portion; and a lumbar supporting die having fixing frames fixed at the upper portion of the rear end of the seat main body, and a supporting plate for supporting lumbar vertebra portion.

In the lumbar support seat according to the present invention, the lumbar supporting die includes a pair of the fixing frames, which are fixed to the seat main body; a pair of supporting frames, which are connected to the fixing frames such that the supporting frames may freely rotate in the back and forth direction; and the supporting plate connected to the pair of supporting frames such that the supporting plate may move in the vertical direction, wherein the supporting frames and the supporting plate may be kept as being folded, and the protrusion length of the supporting plate may be controlled in the vertical direction.

Further, each of the fixing frames of the lumbar supporting die has a hinge connection protrusion portion that is provided at the front side of the upper end thereof, and a rotation guide combined with a stopper protrusion, which is provided at the rear side of the upper end thereof and curved in the shape of an arc, and a lower end portion, which is fixed to the seat main body via a coupling bolt.

Also, each of the supporting frames of the lumbar supporting die has a hinge connection groove portion, which is provided in the center of a lower end thereof so as to be inserted in a hinge connection protrusion portion of each of the fixing frames, an arc-shaped guide surface combined with a stopper groove portion that is provided at the lower portion of a rear surface so as to correspond to the rotation guide combined with the stopper protrusion, and a plurality of latch grooves, which are provided at the upper portion of the rear surface in the vertical direction.

Furthermore, the supporting plate of the lumbar supporting die is indented in the center thereof so that the supporting plate does not directly contact the lumbar vertebra portion, and has a shield section that is integrally formed in the center of the lower portion of a front surface, supporting frame coupling tubular portions that are protrudedly provided at both sides of a rear surface and opened at the lower ends thereof, and elastic holding pieces that are provided in the centers of the rear surfaces of the respective supporting frame coupling tubular portion and have latch holding protrusions.

In the meantime, in the lumbar support seat according to the present invention, the seat main body has air cushions on the base, which is curvedly indented in the center of the upper portion thereof so as to correspond to the shape of the lumbar, and the lumbar supporting die has air cushions on the front surface of the supporting plate.

In addition, the air cushions of the seat main body and the air cushions of the lumbar supporting die are separately formed of left cushion sections and right cushion sections, which are connected to each other via small-diameter connection path.

According to the lumbar support seat according to the present invention as described above, the seat main body has the upper central portion, which is curvedly indented so as to correspond to the shape of pelvis portion, so that the rear portion of the seat main body and the lumbar supporting die provided thereto naturally push the lumbar vertebra portion and the spine as both side buttock portions of a user press the both side edges of the seat main body. Therefore, the lumbar support seat may stably support the lumbar vertebra portion and the pelvis portion, help a user to maintain right sitting posture with straightly extended waist, and prevent the stress of the lumbar vertebra portion in spite of a long time sitting, and the damage or pain of the lumbar vertebra portion.

Further, in the lumbar support seat according to the present invention, the protrusion height of the supporting plate of the lumbar supporting die may be controlled according to the body type of a user, and the air cushions are respectively provided on the upper surfaces of the seat main body and the supporting plate, thereby improving the sitting comfort.

Also, each of the air cushions is divided into the left cushion section and the right cushion section, which are connected to each other by the small-diameter connection path. Therefore, the air charged in any one of the right and left cushion sections slowly moves to the other one via the small-diameter connection path in the case that a load is concentrated on the one of the right and left cushion sections. Accordingly, shock may be reduced in the process of the air flow from one of the air cushion sections to the other one and comfort sitting feeling may be provided.

The lumbar support seat according to the present invention may be packed or carried conveniently, since the supporting plate and the supporting frame of the lumbar supporting die (200) may be rotated in the seat main body direction so as to be folded in a small volume. Furthermore, it is easy to move the lumbar support seat during use since a handle hole is provided in the front portion of the seat main body for the holding of a user.

BRIEF DESCRIPTION OF THE DRAWINGS

The above and other aspects, features and other advantages of the subject matter of the present disclosure will be more clearly understood from the following detailed description taken in conjunction with the accompanying drawings, in which.

DETAILED DESCRIPTION OF THE PREFERRED EMBODIMENT

Hereinafter, an exemplary embodiment of the present invention will be described with reference to accompanying drawings.

Figure 1:
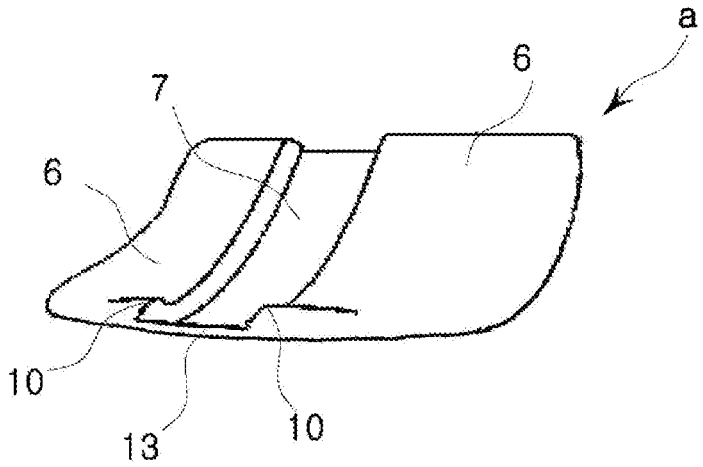
FIG. 1 is a perspective view showing a chair-use auxiliary chair for improving posture according to prior art.
Figure 2:
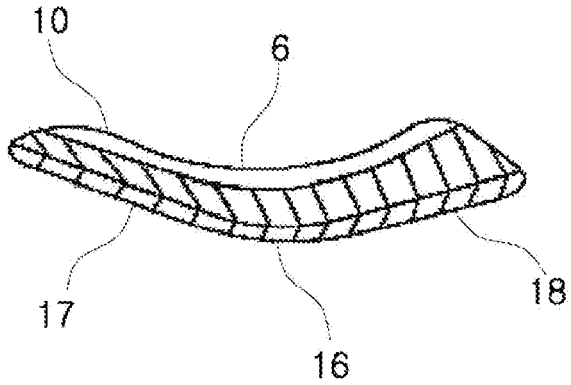
FIG. 2 is a perspective view showing the chair-use auxiliary chair for improving posture according to prior art.
Figure 3:
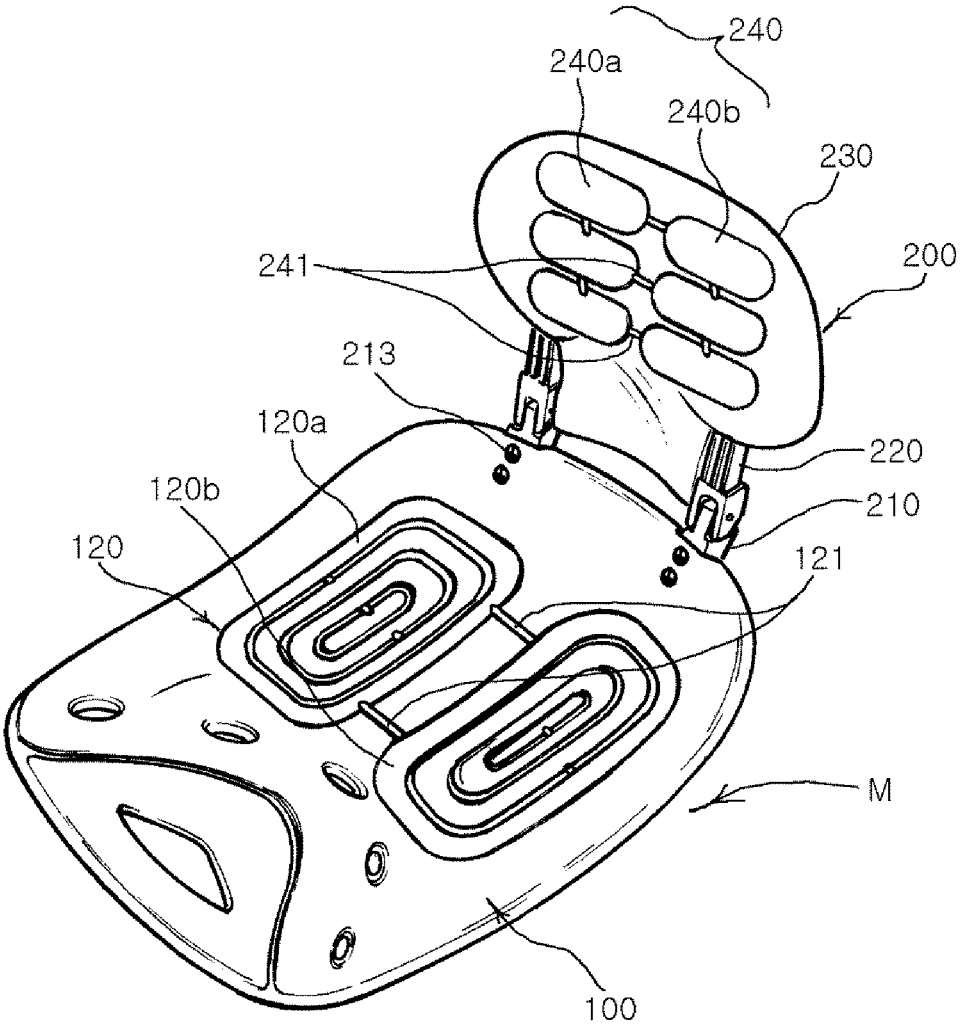
FIG. 3 is a perspective view showing a lumbar support seat for supporting lumbar vertebra portion according to a preferred embodiment of the present invention.
Figure 4:
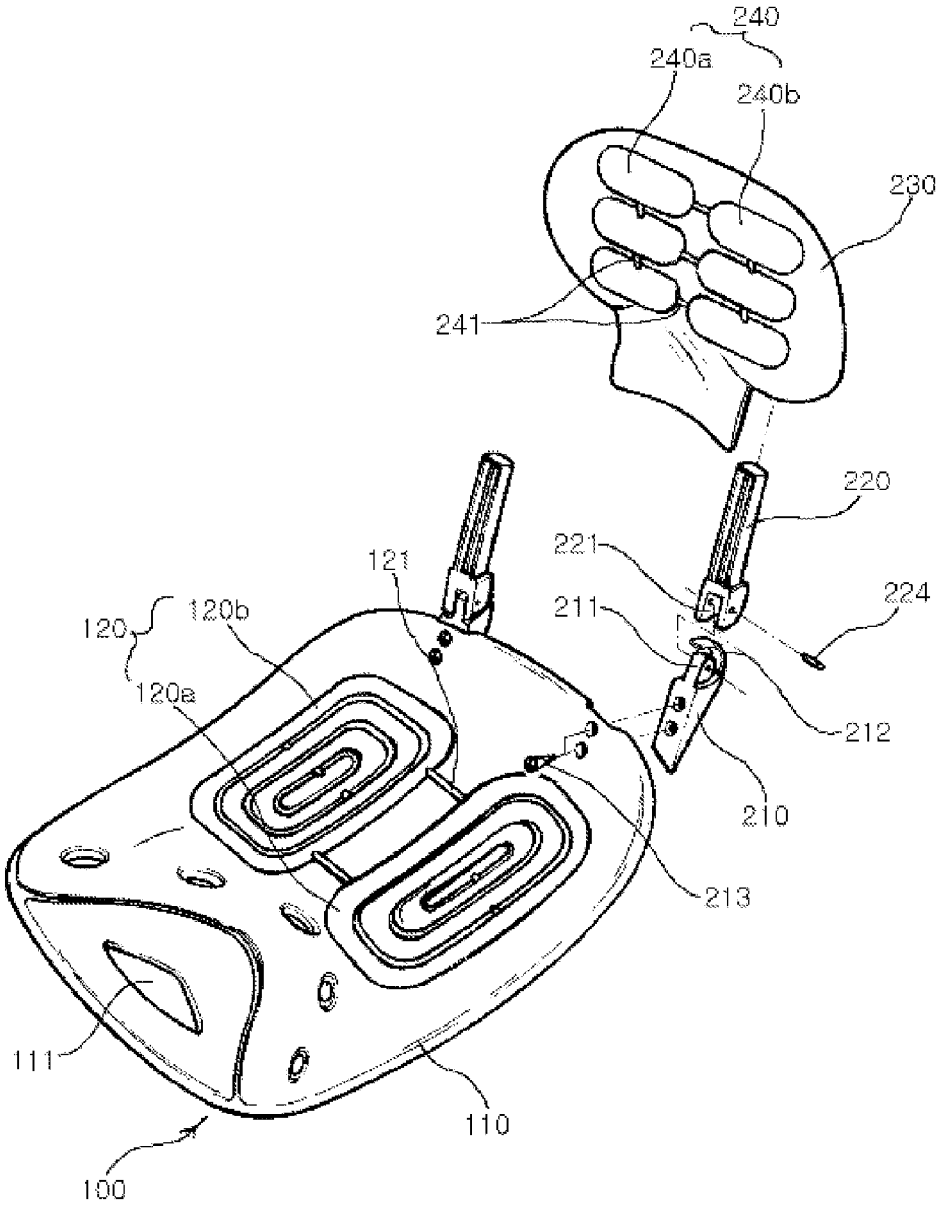
FIG. 4 is an exploded perspective view showing the lumbar support seat for supporting lumbar vertebra portion according to the preferred embodiment of the present invention.
Figure 5:
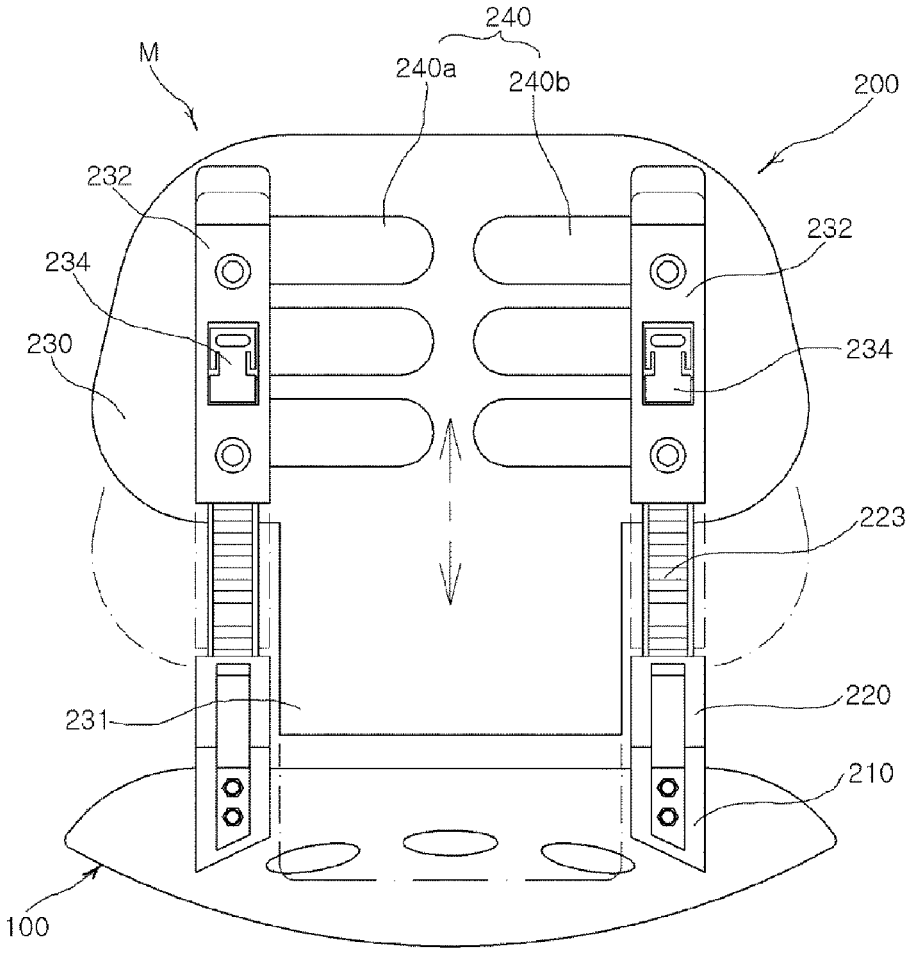
FIG. 5 is a rear view showing the lumbar support seat for supporting lumbar vertebra portion according to the preferred embodiment of the present invention.
Figure 6:
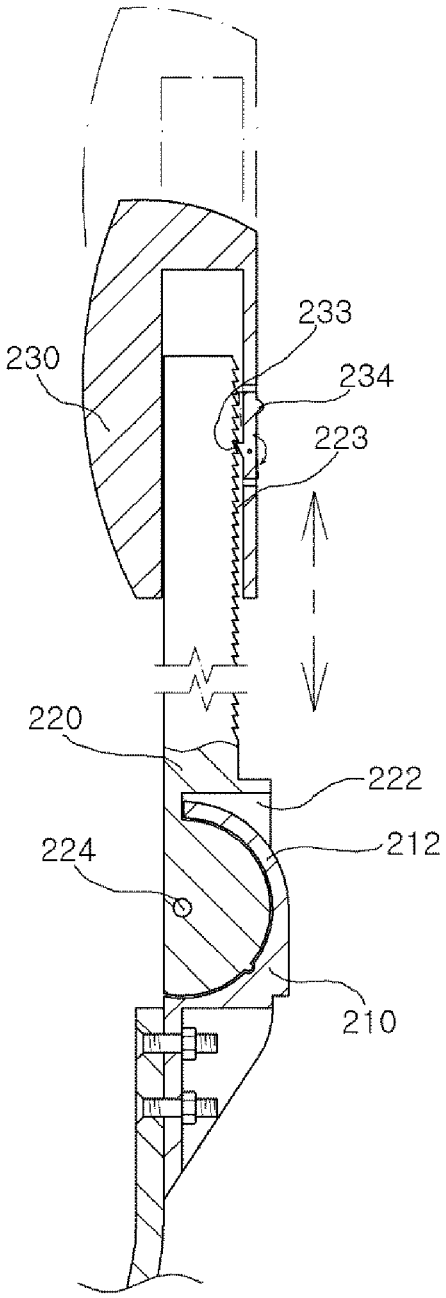
FIG. 6 is a longitudinal cross-sectional view showing the principal parts of the lumbar support seat for supporting lumbar vertebra portion according to the preferred embodiment of the present invention.
Figure 7:
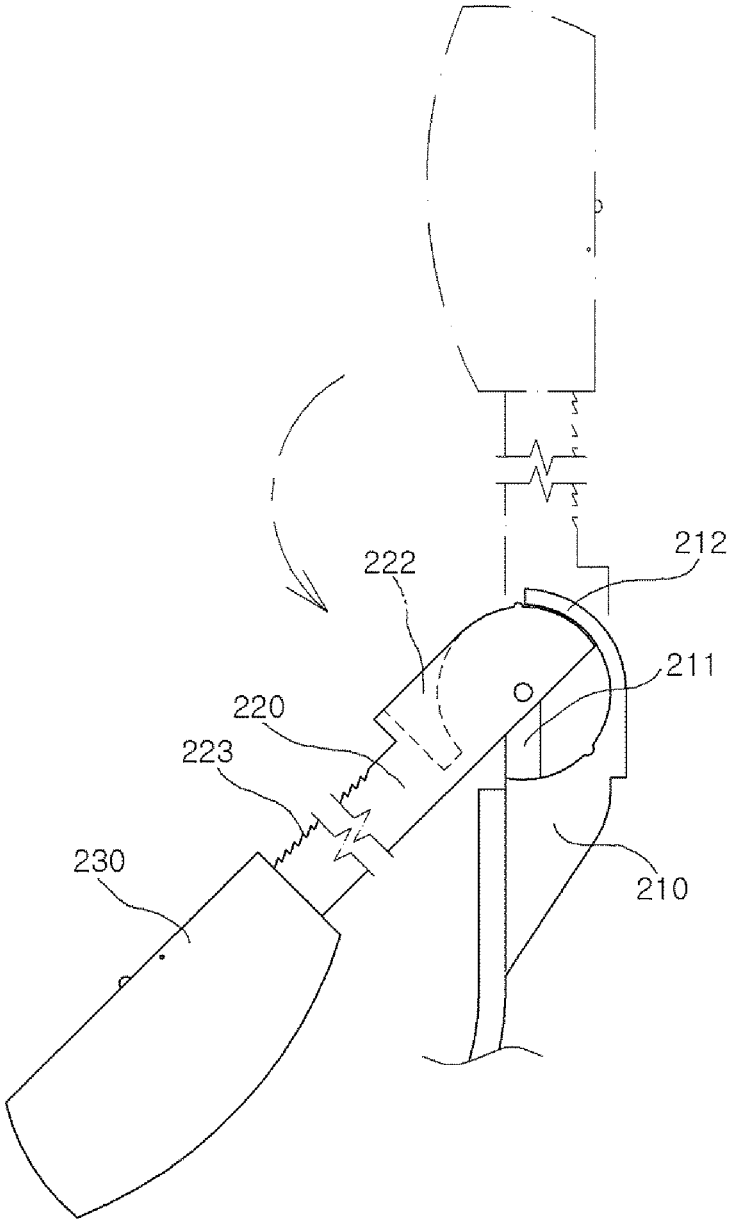
FIG. 7 is a side view showing the principal parts of the lumbar support seat for supporting lumbar vertebra portion according to the preferred embodiment of the present invention, wherein the base plate and the supporting frame of the lumbar support seat for the lumbar are folded.

FIG. 3 is a perspective view showing a lumbar support seat for supporting lumbar vertebra portion according to a preferred embodiment of the present invention, FIG. 4 is an exploded perspective view of the lumbar support seat for supporting lumbar vertebra portion, FIG. 5 is a rear view showing the lumbar support seat for supporting lumbar vertebra portion, FIG. 6 is a longitudinal cross-sectional view showing the principal parts of the lumbar support seat for supporting lumbar vertebra portion, and FIG. 7 is a side view showing the principal parts of the lumbar support seat for supporting lumbar vertebra portion, wherein the base plate and the supporting frame of the lumbar support seat for the lumbar vertebra portion are folded.

Referring to FIGS. 3 to 7, the lumbar support seat M for supporting lumbar vertebra portion according to the present invention includes a seat main body 100, of which an upper central portion is curvedly indented so as to correspond to the shape of pelvis portion; and a lumbar supporting die 200 fixed at the upper portion of the rear end of the seat main body 100 for supporting lumbar vertebra portion.

In the seat main body 100 according to an embodiment of the present invention as shown in FIGS. 3 to 7, air cushions 120 are provided at the upper portion of a base 110, which is curvedly indented so as to correspond to the shape of the pelvis portion.

Each of the air cushions 120 of the seat main body 100 is divided into a left cushion section 120*a* and a right cushion section 120*b*, which are connected to each other via a small-diameter connection path 121.

In the lumbar support seat according to this embodiment as shown in FIGS. 3 to 7, each of the cushion sections 120*a* and 120*b* of the air cushions 120 of the seat main body 100, is formed of a central oval and a plurality of oval rings, which are concentric with the central oval and connected to the central oval or adjacent oval rings via the small-diameter connection path 121. However, the shape of the cushion sections 120*a* and 120*b* of the air cushions 120 of the seat main body 100 is not limited thereto but may be changed in a predictable range.

In the meantime, the lumbar supporting die 200 includes a pair of fixing frames 210, which are fixed to the seat main body 100; a pair of supporting frames 220, which are connected to the fixing frames 210 such that the supporting frames 220 may freely rotate in the back and forth direction; and the supporting plate 230 connected to the pair of supporting frames 220 such that the supporting plate 230 may move in the vertical direction.

In the lumbar support seat according to this embodiment as shown in FIGS. 3 to 7, each of the fixing frames 210 of the lumbar supporting die 200 has a hinge connection protrusion portion 211 that is provided at the front side of the upper end thereof, and a rotation guide combined with a stopper protrusion 212, which is provided at the rear side of the upper end thereof and curved in the shape of an arc, and a lower end portion, which is fixed to the seat main body 100 via a coupling bolt 213.

Each of the supporting frames 220 of the lumbar supporting die 200 has a hinge connection groove portion 221, which is provided in the center of a lower end thereof so as to be inserted in a hinge connection protrusion portion 211 of each of the fixing frames 210, an arc-shaped guide surface combined with a stopper groove portion 222 that is provided at the lower portion of a rear surface so as to correspond to the rotation guide combined with the stopper protrusion 212, and a plurality of latch grooves 223, which are provided at the upper portion of the rear surface in the vertical direction.

The supporting plate 230 of the lumbar supporting die 200 is indented in the center thereof so that the supporting plate 230 does not directly contact the lumbar vertebra portion, and has a shield section 231, which is integrally formed in the center of the lower portion of a front surface, and supporting frame coupling tubular portions 232, which are protrudedly provided at both sides of a rear surface and opened at the lower ends thereof. And, elastic holding pieces 234 are provided in the centers of the rear surfaces of the respective supporting frame coupling tubular portions 232 and have latch holding protrusions 233.

The support plate 230 of the lumbar supporting die 200 is provided with air cushions 240 on the front surface thereof.

Each of the air cushions 240 of the lumbar supporting die 200 is also divided into a left cushion section 240*a* and a right cushion section 240*b*, which are connected to each other via a small-diameter connection path 241, similarly to the air cushions 120 of the seat main body 100.

In the lumbar support seat according to this embodiment as shown in FIGS. 3 to 7, even though each of the cushion sections 240*a* and 240*b* of the lumbar supporting die air cushions 240 are disposed in the vertical direction and provided in the shape of a plurality of rectangular rods, which are connected to adjacent ones via the small-diameter connection paths 241, the shape of the respective cushion sections 240*a* and 240*b* of the lumbar supporting die air cushions 240 is not limited thereto and may be in a predictable range.

Reference sign 111, which is not explained above, indicates a handle hole and reference sign 224, which is not explained above, indicates a hinge connection pin.

Even though the lumbar support seat M according to the present invention as constructed above is intended to be placed on the floor, a chair or sofa, it may be independently used as a chair by preparing the seat main body 100 and the lumbar supporting die 200 with sufficient strength and mounting supporting legs to the lower end of the seat main body 100.

Now, the operational effects of the present invention will be described.

If a user sits on the lumbar support seat M of the present invention in the state that the lumbar support seat M is placed on a chair or sofa, the seat main body 100 may support the pelvis portion of a user via the upper central portion, which is curvedly indented correspondingly to the shape of the pelvis portion. Therefore, the user may sit on the chair in the right posture with the straight waist portion and keep the comfortable sitting posture without the pain of the waist portion.

Further, as the both buttock portions of the user push the both side edges of the concave seat main body 100, the rear portion of the seat main body 100 and the lumbar supporting die 200 provided thereto naturally push the lumbar vertebra portion and the spine so that the lumbar vertebra portion and the pelvis portion may be stably supported. Therefore, the lumbar vertebra portion is not applied with an excessive load in spite of long time sitting and the lumbar vertebra portion may be prevented from the damage or pain.

In the lumbar support seat M of the present invention, if the protrusion height of the supporting plate 230 of the lumbar supporting die 200 may be controlled as shown in the embodiment of FIGS. 3 to 7, it is possible to support the lumbar vertebra portion at a more comfortable position by lifting or lowering the supporting plate 230 according to the body type of a user.

In the meantime, in the lumbar support seat M of the present invention, the upper surface of the seat main body 100 and the front surface of the supporting plate 230 are respectively provided with the air cushions 120 and 240, promoting the sitting comfort.

Furthermore, each of the air cushions 120 and 240 is divided into the left cushion section 120*a*, 240*a* and the right cushion section 120*b*, 240*b*, which are connected to each other via the small-diameter connection path 121, 241. Therefore, the air charged in the left cushion section 120*a*, 240*a* slowly moves to the right cushion section 120*b*, 240*b* via the small-diameter connection path 121, 241 in the case that a load is concentrated on the left cushion section 120*a*, 240*a*. Accordingly, shock may be reduced in the process of the air flow from one of the air cushion section to the other one and comfort sitting feeling may be provided.

In the case that a load is concentrated on the right side pelvis portion or the left side lumbar vertebra portion, the air charged in the right cushion section 120*b* and 240*b* slowly moves to the left cushion section 120*a*, 240*a* via the small-diameter connection path 121, 241 in the similar way, and shock may be reduced in the process of the air flow from one of the air cushion section to the other one and comfort sitting feeling may be provided.

According to the lumbar support seat M of the present invention, the supporting plate 230 and the supporting frame 220 of the lumbar supporting die 200 may be rotated toward the seat main body 100 as shown in FIG. 7 so as to fold the same in a small volume in the case of package or transport. In addition, the lumbar support seat M may be readily carried during use by holding the handle hole 111, which is provided in the front portion of the seat main body 100.

Although preferred embodiments of the present invention have been described for illustrative purposes, those skilled in the art will appreciate that various modifications, additions and substitutions are possible, without departing from the scope and spirit of the invention as disclosed in the accompanying claims.

BRIEF EXPLANATION OF REFERENCE SIGNS

M: lumbar support seat
100: seat main body
110: base
120: air cushions
121: connection path
120*a:* left cushion section
120*b:* right cushion section
200: lumbar supporting die
210: fixing frame
211: hinge connection protrusion portion
212: rotation guide combined with stopper protrusion
213: coupling bolt
220: supporting frame
221: hinge connection groove portion
222: arc-shaped guide surface combined with stopper groove portion
223: latch groove
230: supporting plate
231: shield section
232: supporting frame coupling tubular portion
233: latch holding piece
234: elastic holding piece
240: air cushions
240*a:* left cushion section
240*b:* right cushion section
241: connection path

What is claimed is:

1. A lumbar support seat for positioning the pelvis and supporting the lumbar vertebrae, comprising:

a seat main body having a top surface that is concave so as to correspond to the shape of a human's pelvis and bottom portion that is convex such that a front and rear portion of the seat main body extend upwardly from a middle portion of the seat main body;

a lumbar supporting die forming a supporting plate for supporting the lumbar vertebra;

one or more fixing frames which are secured to a rear side of the rear portion of the seat main body and extend upwardly from the rear portion; and one or more supporting frames which are secured to a rear side of the lumbar supporting die and extend downwardly from the lumbar supporting die to connect with the one or more fixing frames in a hinged connection;

wherein an upper portion of each fixing frame includes a hinge connection protrusion that extends from a front portion of the fixing frame and a stopper protrusion that extends from a rear portion of the fixing frame, the stopper protrusion having an arc shape that extends upwardly overtop the hinge connection protrusion; and wherein a lower portion of each supporting frame forms a hinge connection groove and a stopper groove, the hinge connection groove configured to receive the hinge connection protrusion of a corresponding fixing frame to secure the supporting frame to the fixing frame, the stopper groove extending downwardly into the hinge connection groove to form a surface that the stopper protrusion contact when the lumbar supporting die is rotated away from the seat main body to thereby limit rotation.

2. The lumbar support seat according to claim 1, wherein the lumbar supporting die includes one or more supporting frame tubular portions that are each positioned overtop corresponding supporting frame, wherein the one or more supporting frame tubular portions each include an elastic holding piece that includes a latch holding protrusion, the latch holding protrusion being configured to insert into the latch grooves of the corresponding supporting frame to maintain a vertical position of the lumbar supporting die.

* * * * *